US005136131A

United States Patent [19]

Komaki

[11] Patent Number: 5,136,131

[45] Date of Patent: Aug. 4, 1992

[54] PUSH-BUTTON SWITCH INCLUDING A SHEET PROVIDED WITH A PLURALITY OF DOMED MEMBERS

[75] Inventor: Shigeki Komaki, Nara, Japan

[73] Assignee: Sharp Kabushiki Kaisha, Osaka, Japan

[21] Appl. No.: 587,566

[22] Filed: Sep. 24, 1990

Related U.S. Application Data

[63] Continuation of Ser. No. 110,586, Oct. 19, 1987, abandoned, which is a continuation of Ser. No. 868,589, May 30, 1986, abandoned.

[30] Foreign Application Priority Data

May 31, 1985 [JP] Japan ..... 60-83237[U]

[51] Int. Cl.[5] ..... H01H 1/10

[52] U.S. Cl. ..... 200/516; 200/512; 200/513

[58] Field of Search ..... 200/5 A, 516, 512, 513

[56] References Cited

U.S. PATENT DOCUMENTS 3,133,170 5/1964 Nanninga ..... 200/159 B
3,590,195 6/1971 Driver ..... 200/159 B
4,005,293 1/1977 Boulanger ..... 200/159 B
4,084,071 4/1978 Smith ..... 200/159 B
4,129,758 12/1978 Gilano et al. ..... 200/340
4,463,234 7/1984 Bennewitz ..... 200/516
4,492,829 1/1985 Rodrique ..... 200/159 B

*Primary Examiner*—Henry J. Recla
*Assistant Examiner*—David J. Walczak
*Attorney, Agent, or Firm*—Birch, Stewart, Kolasch & Birch

[57] ABSTRACT

A switch including a springy metallic sheet having a plurality of integrally formed domed members, and a force removing or absorbing element provided within the sheet. The domed members are provided by pressing at a plurality of predetermined positions of the sheet. The force removing or absorbing element includes first slits provided at the peripheral portions of the domed members and second slits provided within the domed members. The slits are provided for removing or absorbing the force caused by the movements of the domed members and for preventing the influence of force to adjacent key portions, and/or for controlling the operating load upon the top of the domed member.

15 Claims, 2 Drawing Sheets

PUSH-BUTTON SWITCH INCLUDING A SHEET PROVIDED WITH A PLURALITY OF DOMED MEMBERS

This application is a continuation of application Ser. No. 110,586 filed on Oct. 19, 1987, now abandoned, which is a continuation of application Ser. No. 868,589 filed May 30, 1986, now abandoned.

BACKGROUND OF THE INVENTION

The present invention relates to an electrical switch and, more particularly, to a snap-type or push-button type key switch, for an electronic calculator, a television, a video tape recorder, or the like, including a sheet provided with a plurality of domed members.

In a key input device for an electronic calculator, or the like, an improvement in the operation of the key input device is desirable. For example, when a key input is carried out, it is desirable that the key input can be judged by the user. Therefore, click-type key switches have been developed, so that the user feels a click at his or her fingertips when the key input device is depressed to input key information.

One example of the above click-type switches is disclosed in U.S. Pat. No. 3,932,722 by Akira Obata et al, entitled "PUSH BUTTON BODY FOR A PUSH-BUTTON SWITCH PROVIDING SNAP-ACTION OF THE SWITCH". It is impossible, however, to form a flat and thin type switch in the push button of Obata et al.

Another example of the above type of switches is disclosed in U.S. Pat. No. 3,590,195 by Driver Douglas Louis Ashton, entitled "OILCAN PUSHBUTTON SWITCH". FIG. 5 shows a sectional view of a pushbutton such as that disclosed in U.S. Pat. No. 3,590,195. A plate is designated by numeral 100, and insulative sheets are designated by numerals 101 and 102. A plurality of first key contacts 103 are provided on the insulative sheet 102. The insulative sheet 101 functions as a spacer. The plate 100 is formed with a plurality of domed members 104 and may be made of an insulative sheet or a conductive sheet. Each of a plurality of second contacts 105 are formed on the inner surface of the domed members 104. Each of the domed members 104 is opposite to each of the plurality of first key contacts 103 provided on the insulative sheet 102 so as to provide an electrical connecttion between one of the first contacts 103 and a corresponding one of the second contacts 105 when the domed member 104 is depressed. The insulative sheet 101 has openings therein at portions corresponding to the domed members 104. The plate 100, and the insulative sheets 101 and 102 are layered with respect to each other. A rivet 106 is provided to forcibly clip or connect the plate 100 to the insulative sheets 101 and 102.

If the plate 100 is the insulative plate of plastic film such as polyester, it is easy to form the key switch, but the durability of the switch is decreased. When a large number of key switching operations are carried out, the user may eventually be unable to feel the click.

If the plate 100 is the conductive sheet of metallic material, the durability of the key switch is improved, but the force caused by the up/down movements of the domed members cannot be removed and may cause stress to the flat portions at the edges of the domed member (namely, the connecting portion between the plate 100 and the insulative sheet 101). Accordingly, the operation load caused by the key switching increases.

That switch cannot be employed in a flat and thin apparatus. As the domed members 104 are integrally provided to a single flat sheet, the shape of the sheet may be changed when forming the domed members 104, and may be distorted. In the switch of FIG. 5, the rivet 106 is provided for securely clipping the plate 100 to the insulative members 101 and 102 in addition to an adhesive. Therefore, additional members are required for a securable connection between the sheet 100 and the insulative sheets 101 and 102. If the rivet 106 is not provided, the peripheral portions of the domed members 104 are separated from the insulative sheet 102 in directions b and c when the domed member 104 is depressed in a direction a. The stability of the switch is thus decreased. In the switch of FIG. 5, some rivets 106 must be provided between the adjacent keys to prevent the sheet 101 from separating from the sheet 102.

SUMMARY OF THE INVENTION

Accordingly, it is an object of the present invention to provide an improved switch which enables a suitable key switching operation without influencing adjacent keys.

It is another object of the present invention to provide an improved key switch which clicks when depressing a key top, improves the durability of the switch, and prevent adjacent keys from being excessively separated from their key contacts.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

To achieve the above objects, according to an embodiment of the present invention, a switch comprises a springy metallic sheet having a plurality of integrally formed domed members, and means for removing or absorbing force provided within the sheet. The domed members are actuated by pressing at the predetermined domed positions of the sheet. The means for removing or absorbing force are first slits provided at the peripheral portions of the domed members and second slits provided within the domed members. The slits are provided for removing or absorbing the force caused by the movements of the domed members thereby preventing undue influence to adjacent key positions and/or for controlling the operating load on the top of the domed member.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE PREFERRED EMBODIMENTS

Figure 1:
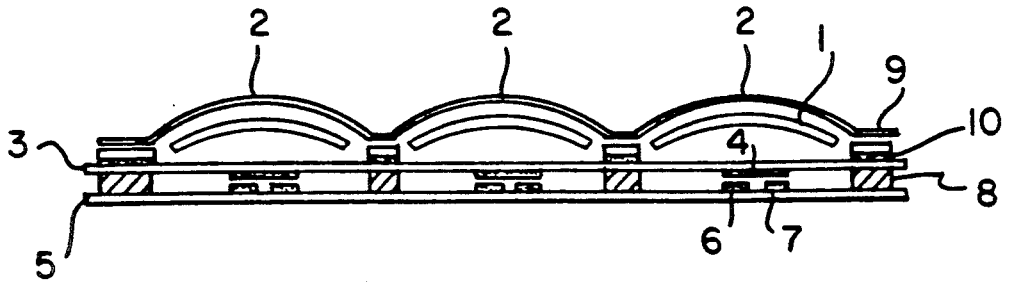
FIG. 1 shows a sectional view of a push-buttom switch according to an embodiment of the present invention.

A push-button switch according to an embodiment of the present invention will be described with reference to FIGS. 1 through 4. FIG. 1 shows a sectional view of a push-button switch used in a thin-type electronic calculator.

A push-button switch comprises a springy metallic sheet 1, such as a stainless sheet or phosphorus bronze sheet, integrally provided with a plurality of snap-action movable members 2 of a domed form, a key contact sheet 3 having a plurality of key contacts 4 thereon, and a substrate 5 having a plurality of pairs of electrical conductors 6 and 7 between which electrical connection is effected upon operation of the switch, a spacer 8 for separating between the key contact sheet 3 and the substrate 5, and a decoration sheet 9 adhered on the springy metallic sheet 1. The substrate 5 and the key contact sheet 3 may include necessary wiring patterns thereon. IC or LSI controls the operation of the apparatus. A display such as a liquid crystal display, and a power supply such as a solar power cell may be provided with the above switch structure.

The sheet 1 is adhered on the key contact sheet 3 by an adhesive 10 so that one of the domed members 2 is provided over one of the key contacts 4 of the key contact sheet 3. The decoration sheet 9 adhered on the sheet 1 has key symbols over the domed members 2. For example, when the switch is used in the electronic calculator, the key symbols are "0", "1", "2", . . . , "8", "9", "×", "÷", "+", "−", "=", or the like are provided. The key contact sheet 3 and the substrate 5 are made of an insulative material and may be flexible. The key contact sheet 3 and the substrate 5 are layered via the spacer 8 so that each of the plurality of key contacts 4 are opposite to a pair of electrical conductors 6 and 7 via the opening in spacer 8.

When the top of the domed member 2 is depressed, the sheet 1 and the decoration film 9 are also depressed. After the sheet 1 connects with the key contact sheet 3, the sheet 1 and the key contact sheet 3 are further, moved down so that the contact 4 comes in contact with the electrical conductors 6 and 7 to provide the electrical connection between the electrical conductors 6 and 7.

Figure 2:
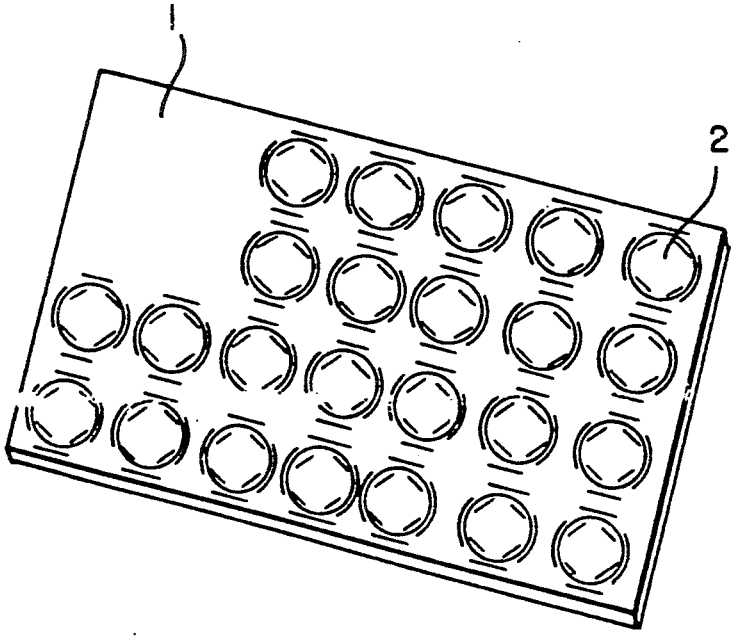
FIG. 2 shows a perspective view of a springy metallic sheet having a plurality of integrally formed domed members used in the push-button switch of FIG. 1.
Figure 3:
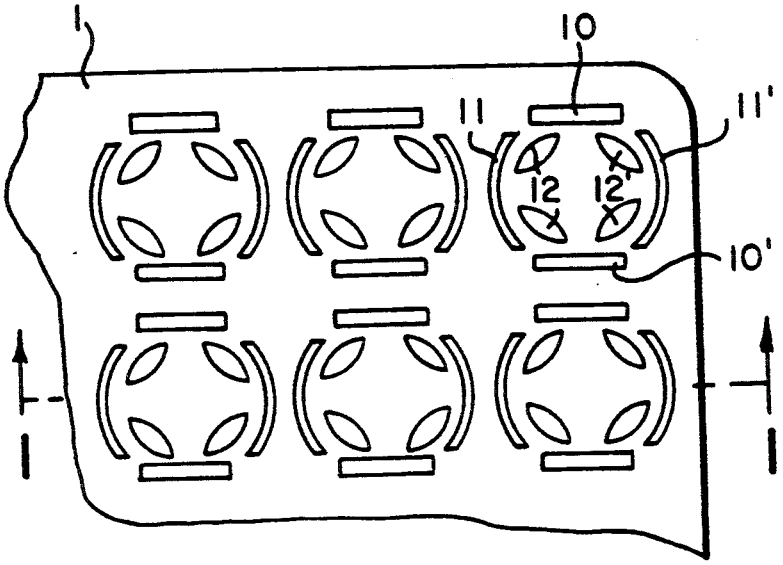
FIG. 3 shows a partial plan view of the springy metallic sheet of FIG. 2.
Figure 4:
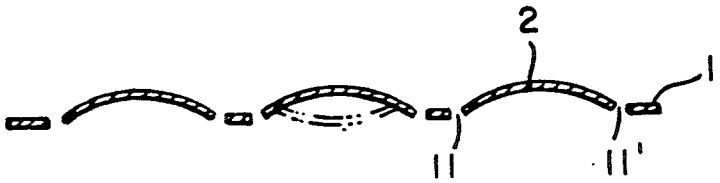
FIG. 4 shows a sectional view of the springy metallic sheet taken along a line I—I of FIG. 3.
Figure 5:
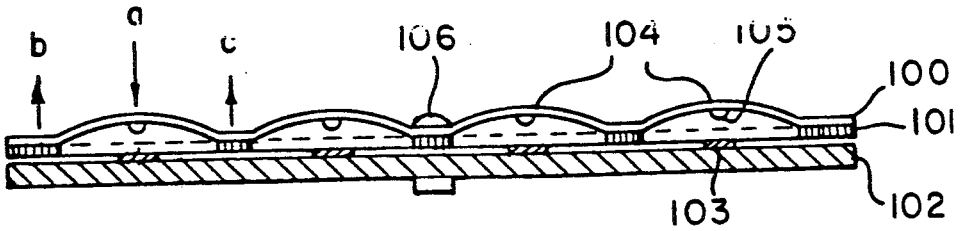
FIG. 5 shows a sectional view of a conventional push-button switch of U.S. Pat. No. 3,590,195.

FIG. 2 shows a perspective view of the springy metallic sheet used in the switch according to an embodiment of the present invention. FIG. 3 shows a partial plan view of the springy metallic sheet of FIG. 2. FIG. 4 shows a sectional view of the springy metallic sheet of FIG. 2 taken along a line I—I.

First slits 10 and 10' and second slits 11 and 11' are within the springy metallic sheet 1 for removing or absorbing the force caused by the movements of the domed members 2, or the force applied at the rims of the domed members 2, and for eliminating any influence on the adjacent keys. The first slits 10 and 10' and the second slits 11 and 11' are formed at peripheral edges of each of the domed members 2. The first slits 10 and 10' are symmetrically oppossed to each other, and the second slits 11 and 11' are also symmetrically oppossed to each other. The shape of the first slits 10 and 10' are preferably rectangular in form, and the shape of the second slits 11 and 11' is a circular form, preferably.

Two pairs 12 and 12', of third slits are provided for each of the domed members 2 for controlling or reducing an operation load applied to the top of the domed members 2 or the load due to key depression. One pair of the third slits 12 and 12' are symmetrical to each other, and the other pair of the group 12 and 12' are also symmetrical to each other. The shape of the third slits is an ellipitical form, preferably.

The shape of each of the slits should not be limited to the above. The shape, the size and the position of each of the first, second and third slits may be changed so as to uniformly absorb the force applied to the peripheral edges of the domed member 2 and to control the operation load upon the top of the domed member 2. The number and the size of each of the first, second, and third slits may be changed according to a desired control range. The first slits, the second slits, and the third slits may be symmetrical, respectively.

The sheet 1 is manufactured as follows. A flat springy metallic sheet is provided. The positions of the slits are determined based upon the positions of the domed members 2 to be formed. The slits are formed by an etching, stamp-out process, or a pressing process. Finally, the movable domed members 2 are formed by pressing to form all domed members 2 at once.

As described above, the switch of the present invention includes the springy metallic sheet having the plurality of integrally formed domed members formed by pressing to reduce the cost of the switch. Because the slits are provided at the peripheral edges of the domed members and/or within the domed members, the operating load applied to the top of the domed member can be reduced and becomes light. If the slits are not provided, the sheet having the plurality of integrally formed domed members may be distorted. The reason for distortion of the domed members without slits is that the sheet is forced to absorb stress throughout by a strain caused by pressing the domed members. If, as the present invention, the slits are provided, the strain caused by pressing can be eliminated, so that the flat sheet having domed members can be utilized. Also, when the domed member is depressed as shown by two-dot chain line in FIG. 4, the peripheral and adjacent keys are not influenced by the key switching operation because of the peripheral slits. As the user feels a click when the key switching operation is carried out, the input of the information can be confirmed and can be accurately carried out.

The springly metallic sheet means a flexible metallic sheet.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A push-button matrix switch array comprising:

a flexible and insulative substrate layer having a plurality of first conductive contacts formed on a first major surface of said substrate;

a flexible and insulative key contact layer having a plurality of second contacts formed on a second major surface of said key contact layer;

said key contact layer being formed over said substrate in a parallel and spaced relationship wherein each of said plurality of first conductive contacts are aligned with corresponding ones of said plurality of said second conductive contacts;

a metallic sheet formed on a first major surface of said key contact layer and having a plurality of integrally formed domed members arranged in a two dimensional matrix, each of said plurality of domed members being selectively actuable to enable an electrical connection between corresponding ones of said first and second conductive contacts;

means for uniformly absorbing a radial force which would otherwise be applied to peripheral edges of said plurality of domed members caused by actuation of said plurality of domed members, said means for uniformly absorbing being at least one pair of symmetrically formed apertures around the periphery of each of said plurality of domed members;

means for reducing an operation load applied to each of said plurality of domed members caused by actuation of one of said plurality of domed members, said means for reducing being at least one pair of symmetrically formed apertures through the surface of each of said plurality of domed members, whereby said apertures are positioned such that any radius extending from the center of a domed member to a point beyond said periphery surrounding said domed member will intersect at least one of said apertures; and means for connecting said metallic sheet to said key contact layer.

2. The push-button matrix switch array according to claim 1, wherein each of said plurality of domed members includes two pairs of symmetrically opposed slits formed therethrough.

3. The push-button matrix switch array according to claim 1, wherein said means for absorbing a radial force comprise a pair of diametrically opposed arcuate apertures formed through said metallic sheet around the periphery of each of said plurality of domed members.

4. The push-button matrix switch array according to claim 3, wherein said means for absorbing a radial force further comprise a pair of diametrically opposed rectangular apertures formed through said metallic sheet around the periphery of each of said plurality of domed members and alternating with said arcuate apertures.

5. The push-button matrix switch array according to claim 4, wherein said means for reducing an operation load comprise four elliptical apertures formed through the surface of each of said plurality of domed members, said elliptical apertures being symmetrically arranged as two opposing pairs of elliptical apertures.

6. The push-button matrix switch array according to claim 5, wherein said elliptical apertures have a longitudinal axis thereof positioned at an angle with respect to said arcuate and rectangular apertures, such that the longitudinal axis of each of said elliptical apertures intersects at least one said one said arcuate apertures and one of said rectangular apertures at a position intermediate an overall length of said arcuate and rectangular apertures.

7. The push-buttom matrix switch array according to claim 6, wherein said angle is at 45 degrees with respect to the intermediate position of said arcuate and rectangular apertures.

8. The push-button matrix switch array according to claim 1, further including means for identifying said plurality of domed members by the use of a decorative film overlying said metallic sheet.

9. The push-button matrix switch array according to claim 8, wherein said decorative film has a shape corresponding to said metallic sheet including a corresponding plurality of integrally formed domed members arranged in a two-dimensional matrix thereby enabling tactile location of each of said plurality of domed members in said metallic sheet.

10. The push-button matrix switch array according to claim 1, wherein said means for connecting said key contact layer to said metallic sheet is by the use of an adhesive.

11. A push-button matrix switch array comprising:

a flexible and insulative substrate layer having a plurality of first conductive contacts formed on a first major surface of said substrate;

a flexible and insulative key contact layer having a plurality of second contacts formed on a second major surface of said key contact layer;

said key contact layer being formed over said substrate in a parallel and spaced relationship wherein each of said plurality of first conductive contacts are aligned with corresponding ones of said second conductive contacts;

a metallic sheet formed on a first major surface of said key contact layer and having a plurality of integrally formed domed members arranged in a two-dimensional matrix, each of said plurality of domed members being selectively actuable to enable an electrical connection between corresponding ones of said first and second conductive contacts;

means for uniformly absorbing force which would otherwise be applied to peripheral edges of said plurality of domed members upon actuation of one of said plurality of domed members, said means for uniformly absorbing including a pair of diametrically opposed arcuate apertures formed through said metallic sheet around the periphery of each of said plurality of domed members and a pair of diametrically opposed rectangular apertures formed through said metallic sheet around the periphery of each said plurality of domed members and alternating with said arcuate apertures;

means for reducing an operation load applied to each of said plurality of domed members upon actuation thereof, said means for reducing including four elliptical apertures formed through the surface of each of said plurality of domed members, said elliptical apertures being symmetrically arranged and having a longitudinal axis thereof positioned at an angle with respect to said arcuate and rectangular apertures, such that the longitudinal axis of each of said elliptical apertures intersects at least one of said arcuate apertures and one of said rectangular apertures at a position intermediate an overall length of said arcuate and rectangular apertures, whereby said apertures are positioned such that any radius extending from the center of a domed member to a point beyond said periphery surrounding said domed member will intersect at least one of said apertures; and means for connecting said metallic sheet to said key contact layer.

12. The push-button matrix switch array according to claim 11, wherein said angle is at 45 degrees with respect to the intermediate position of said arcuate and rectangular apertures.

13. The push-button matrix switch array according to claim 11, further including means for identifying said plurality of domed member by the use of a decorative film overlying said metallic sheet.

14. The push-button matrix switch array acoording to claim 13, wherein said decorative film overlaying said metallic sheet includes a corresponding plurality of integrally formed domed members arranged in a two-dimensional matrix thereby enabling tactile location of the each of said plurality of domed members in said metallic sheet.

15. The push-button matrix switch array according to claim 11, wherein said means for connecting said key contact layer to said metallic sheet is by the use of an adhesive.

* * * * *